US005445139A

United States Patent [19]

Bybee

[11] Patent Number: 5,445,139

[45] Date of Patent: Aug. 29, 1995

[54] HYDRAULIC/PNEUMATIC BOOST SYSTEM FOR ARCHERY BOW AND CROSSBOW

[75] Inventor: Mark T. Bybee, New Port Richey, Fla.

[73] Assignee: Barnett International, Inc., Odessa, Fla.

[21] Appl. No.: 192,700

[22] Filed: Feb. 7, 1994

[51] Int. Cl.[6] ..... F41B 5/00

[52] U.S. Cl. ..... 124/23.1; 124/25; 124/86

[58] Field of Search ..... 124/1, 23.1, 24.1, 25, 124/25.6, 86, 88

[56] References Cited

U.S. PATENT DOCUMENTS

| | | | |
|---|---|---|---|
| 3,552,373 | 1/1971 | Van Hecke . | |
| 3,561,419 | 2/1971 | Cucuzza | 124/25 |
| 3,625,193 | 12/1971 | Palma . | |
| 3,913,556 | 10/1975 | Palma | 124/23.1 X |
| 3,957,027 | 5/1976 | Drake . | |
| 4,433,833 | 2/1984 | Tabe et al. . | |
| 4,471,747 | 9/1984 | Nishioka | 124/23.1 |
| 4,478,202 | 10/1984 | Anderson | 124/23.1 |
| 4,603,676 | 8/1986 | Luoma | 124/25 |
| 5,115,795 | 5/1992 | Farris | 124/86 |
| 5,205,269 | 4/1993 | Guzzetta | 124/25.6 |
| 5,220,906 | 6/1993 | Choma | 124/25 |
| 5,222,473 | 6/1993 | Lint | 124/86 |

*Primary Examiner*—John A. Ricci
*Attorney, Agent, or Firm*—Pettis & McDonald

[57] ABSTRACT

Fluid pressure is exerted upon fulcrum or inner end points of the arms of bows (including crossbows, archery bows, and compound bows). The fluid pressure expands fluid cylinders which pull the inner ends of, or push the middle of, the bent arms of the bow. The resulting increase in tension in the arms of the bow produces greater distance traveled, velocity, and therefore accuracy of the missile, when the string is released.

10 Claims, 5 Drawing Sheets

HYDRAULIC/PNEUMATIC BOOST SYSTEM FOR ARCHERY BOW AND CROSSBOW

BACKGROUND OF THE INVENTION

1. Field of the Invention

The present invention relates to bows including crossbows, archery bows, and compound bows for target shooting or hunting, having fluid pressure devices such as hydraulics to increase the tension on the bow.

2. Description of the Prior Art

Bows, including crossbows, archery bows, and compound bows, have been well known for hundreds of years. Specific examples of existing art in this field include:

| Inventor(s) | Pat. No. |
|---|---|
| Jerome M. Van Hecke | 3,552,373 |
| James R. Palma | 3,625,193 |
| Harry E. Drake | 3,957,027 |
| Takayuki Tabe, et al. | 4,433,833. |

It is well known that increased tension on bows, including crossbows, archery bows, and compound bows, produces greater power, range, speed and accuracy. Before the present invention, greater tension was achieved by greater exertion by the person pulling the string. The present invention provides for fluidic tensioning, which is especially useful with crossbows and compound bows. The increase in tension achieved with the present invention is disproportionate to the effort of the person using the bow, which includes crossbows, archery bows, and compound bows.

SUMMARY OF THE INVENTION

Fluid pressure is exerted upon fulcrum or end points of the arms of bows including crossbows, archery bows, and compound bows. The resulting increase in tension in the arms of the bow, when released, produces force which results in greater distance traveled, velocity, and therefore accuracy, of the missile projected.

The invention accordingly comprises:

- the several steps and the relation of one or more of such steps with respect to each of the others thereof;
- the features of construction, combination of elements, and arrangement of parts; and
- an article of manufacture possessing the features, properties, and the relation of elements;
- all of which will be exemplified in the method, construction, and article hereinafter described and the scope of the invention will be indicated in the claims.

BRIEF DESCRIPTION OF THE DRAWINGS

For a full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
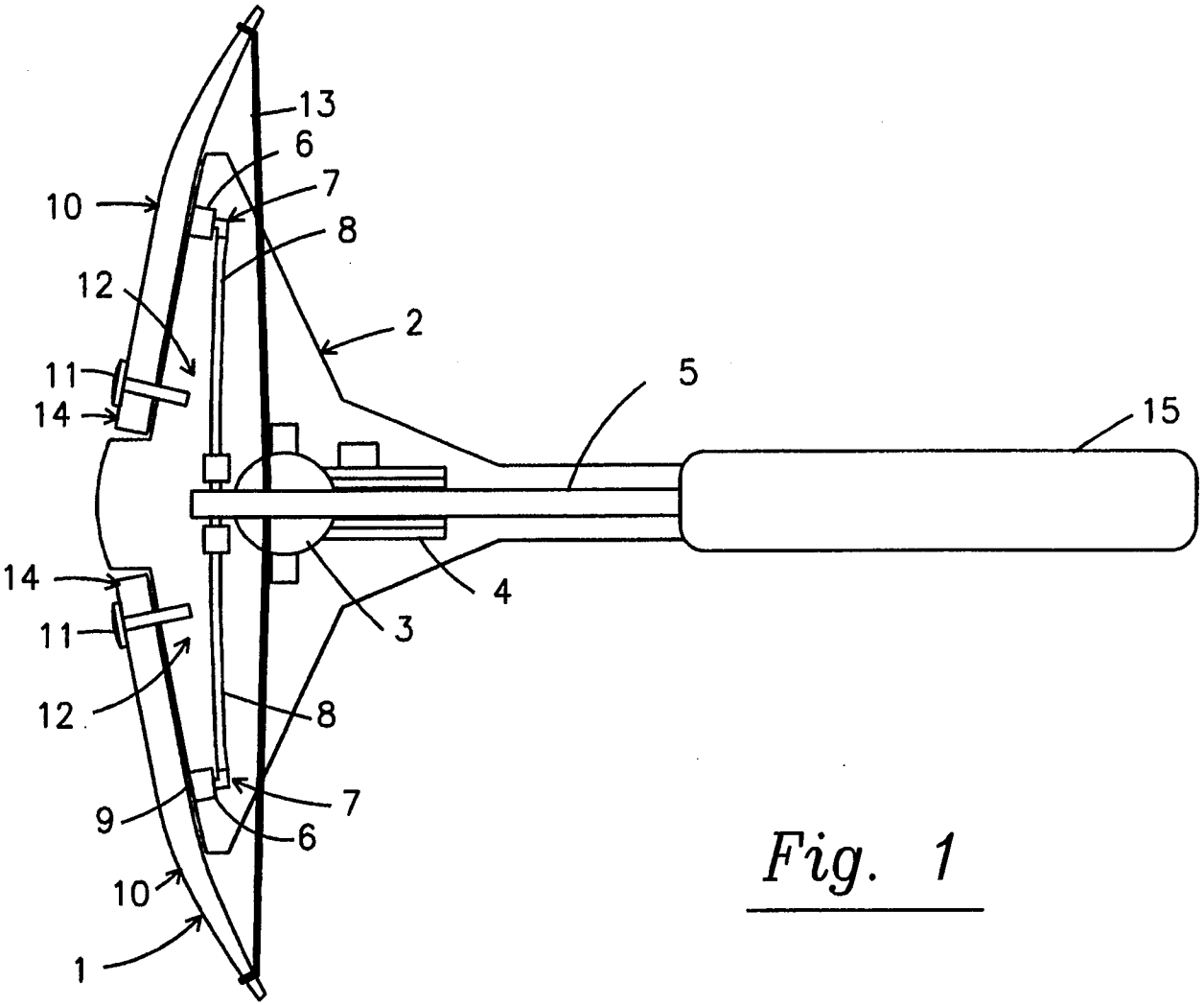
FIG. 1 is a bottom view of a crossbow embodying the present invention, de-activated.

In FIGS. 1–5, the front end is to the left.

For this description, use of the word "bow" shall include crossbows, archery bows, and compound bows. All bows project a missile, variously called an arrow, bolt, or quarrel, starting from a point of tension, in which the missile rests with one end against a string, cable, or wire ("string") 13. The position of the string 13 has potential energy associated with it due to tension in the arms of the bow. The string 13 is attached at either end to the tensioning arms, generally indicated as 1, of the bow, which are all held pivotally at their inner ends, generally indicated as 14, on a frame, generally indicated as 2. Release of a restraining force in the general middle of the string 13, where the missile end rests, results in release of the tension in the arms 1, and resulting rapid forward movement of the missile.

Crossbow embodiments of the present invention often have a stock 15 attached to the rear end of the frame 2.

An increase in the tension of the arms 1 results in greater force being applied to the missile following release of the string 13, and has generally been achieved by pulling the string 13 further back from the front end of the frame 2 to which the arms 1 are attached. Pulling the string 13 back as described produces increased energy for the missile proportional to the effort exerted in pulling back the string 13. To obtain an increase in missile speed before the present invention, greater and greater effort was required in pulling back the string 13, limiting the speed, distance, and accuracy of the missile to the strength of the person using the bow ("user").

Crossbows and compound bows permit the string 13 to be locked in the pulled position and held there with minimal effort to the user. This is due to the let-off in draw weight at full draw achieved by compound bows and compound crossbows.

Once the string 13 is locked with the bow in a bent position, an increase in tension of the arms 1 of the bow does not result in a proportional increase in effort to the user. Prior to this invention, this increase in tension, however, could only be achieved by a proportional increase in effort by the user.

This invention permits the increase of pressure of a fluid, such as an hydraulic fluid or a gas to be translated into increased tension on string 13. This increased fluid pressure is created by pumping means such as a fluid pump 3, which might be an hydraulic pump or air pump. This fluid pump may be connected to a fluid reservoir 4, such as an hydraulic reservoir. This fluid reservoir 4 may be located inside the frame 2 or may be mounted to the frame 2. Pumping action may be achieved through motion of a pump arm 5 connected to the fluid pump 3 and moving in an arc below the frame 2. This pump arm 5 may be placed below a crossbow or forward of the archery bow frame 2. Alternatively, the pumping action may be achieved through well-known electrical pumping means.

Figure 2:
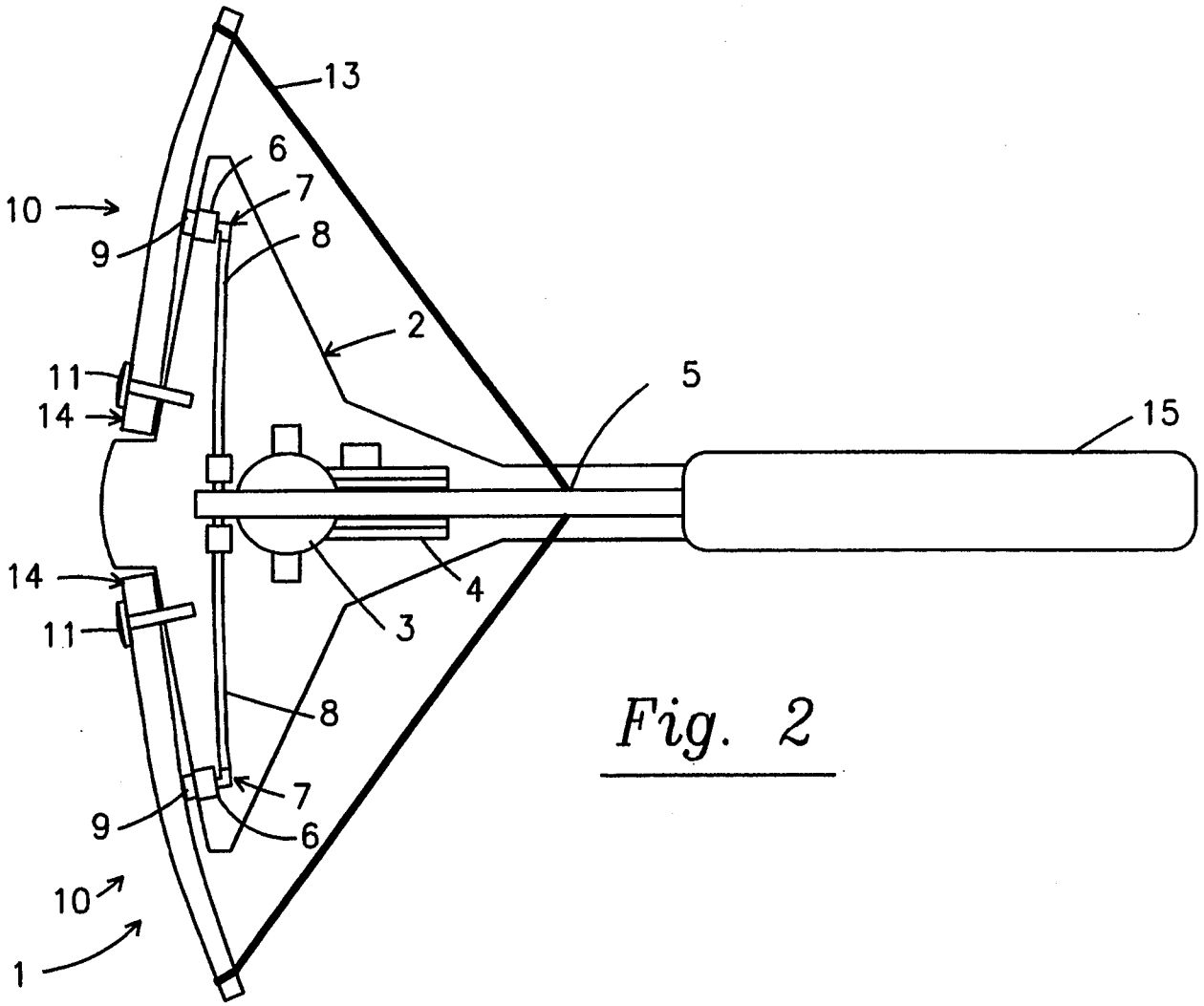
FIG. 2 is a bottom view of a crossbow according to the present invention, activated.

FIGS. 1 and 2

FIGS. 1 and 2 depict a crossbow according to the present invention. In this embodiment, increased fluid pressure is conveyed from the pump 3 to the fluid cylinders 6 which are mounted to a fluid cylinder area, or tensioning arm fulcrum area, generally indicated as 7, on the frame 2. The inner ends 14 of the tensioning arms 1 are held to the frame 2 by use of pinions 11 which attach the inner ends 14 to pinion areas, generally indicated as 12, of the frame 2. When the string 13 is pulled back, as in FIG. 2, the tensioning arms 1 press against the fulcrum areas 7. Since the inner ends 14 are held by the pinions 11, and the outer ends of the tensioning arms 1 are being pulled by the string 13, potential energy in the form of tension/bending is stored in the tensioning arms as they bend against the fulcrum areas 7. The greater this bending angle becomes, the greater the potential energy available for delivery to the missile.

The increased fluid pressure is then conveyed from the pump 3 to the fluid cylinders 6 attached to a fluid cylinder area, or tensioning arm fulcrum area, generally indicated as 7, of the frame 2. Fluid cylinder areas are generally on the front end of the frame 2. The fluid cylinders 6 act as pistons and expand as a result of the fluid pressure. The fulcrum areas 7 may be located at extremities of the frame 2. The fluid pressure increase is conveyed by fluid lines 8, which may be made of plastic tubing. In one embodiment, the expanding cylinders 6 engage means for converting changes in fluid cylinder 6 extension into increased bending and tension of the tensioning arms 1, or rams 9. These rams press upon a central section, generally indicated as 10, of the tensioning arms 1. Pressure upon the generally central section 10, if the inner end 14 and outer end of the tensioning arm 1 is held, will increase the bending, tension, and potential energy in the tensioning arm 1. When released, this tension produces greater speed in the missile.

Figure 3:
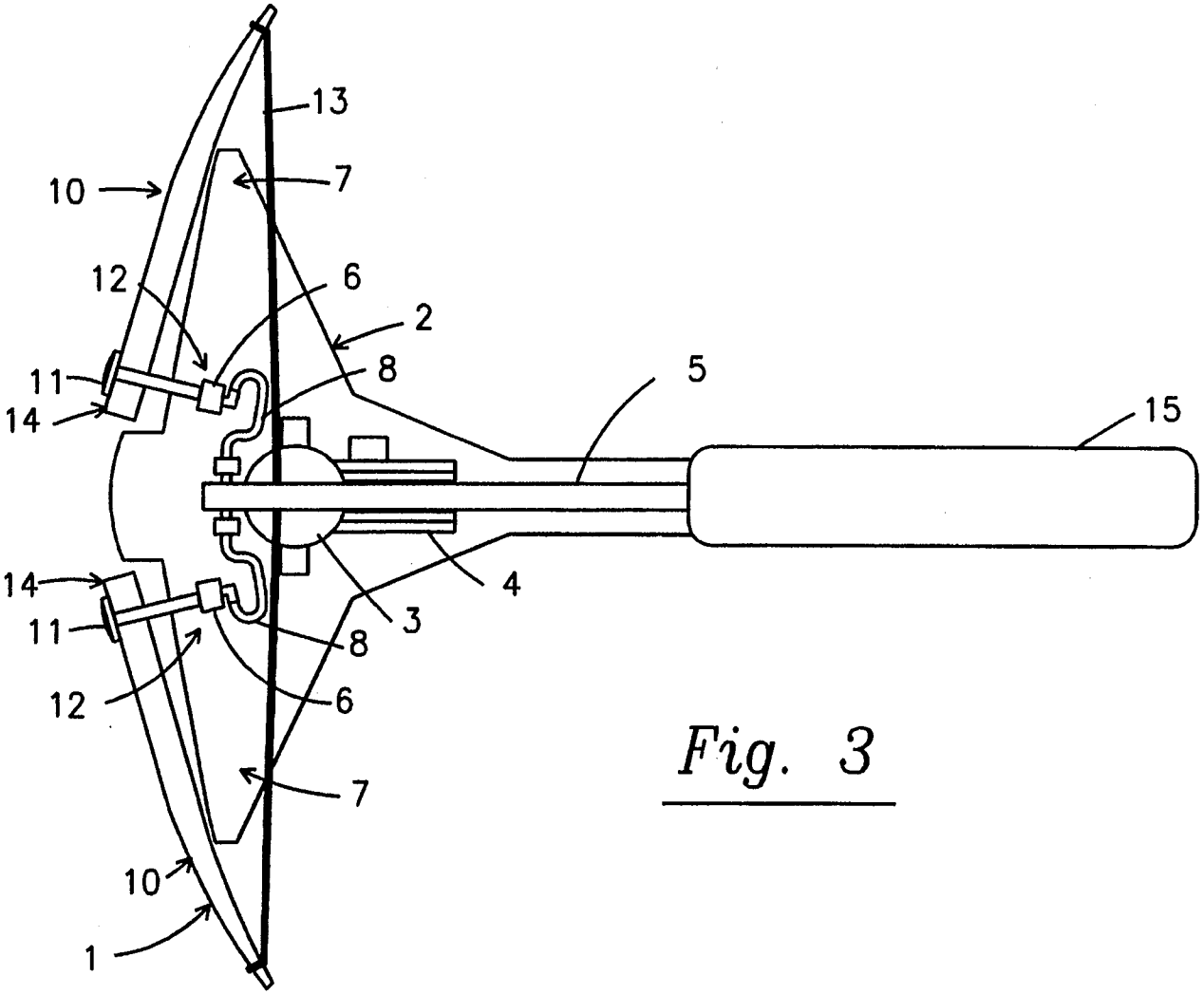
FIG. 3 is a bottom view of a crossbow according to the present invention, incorporating the pinion embodiment, deactivated.
Figure 4:
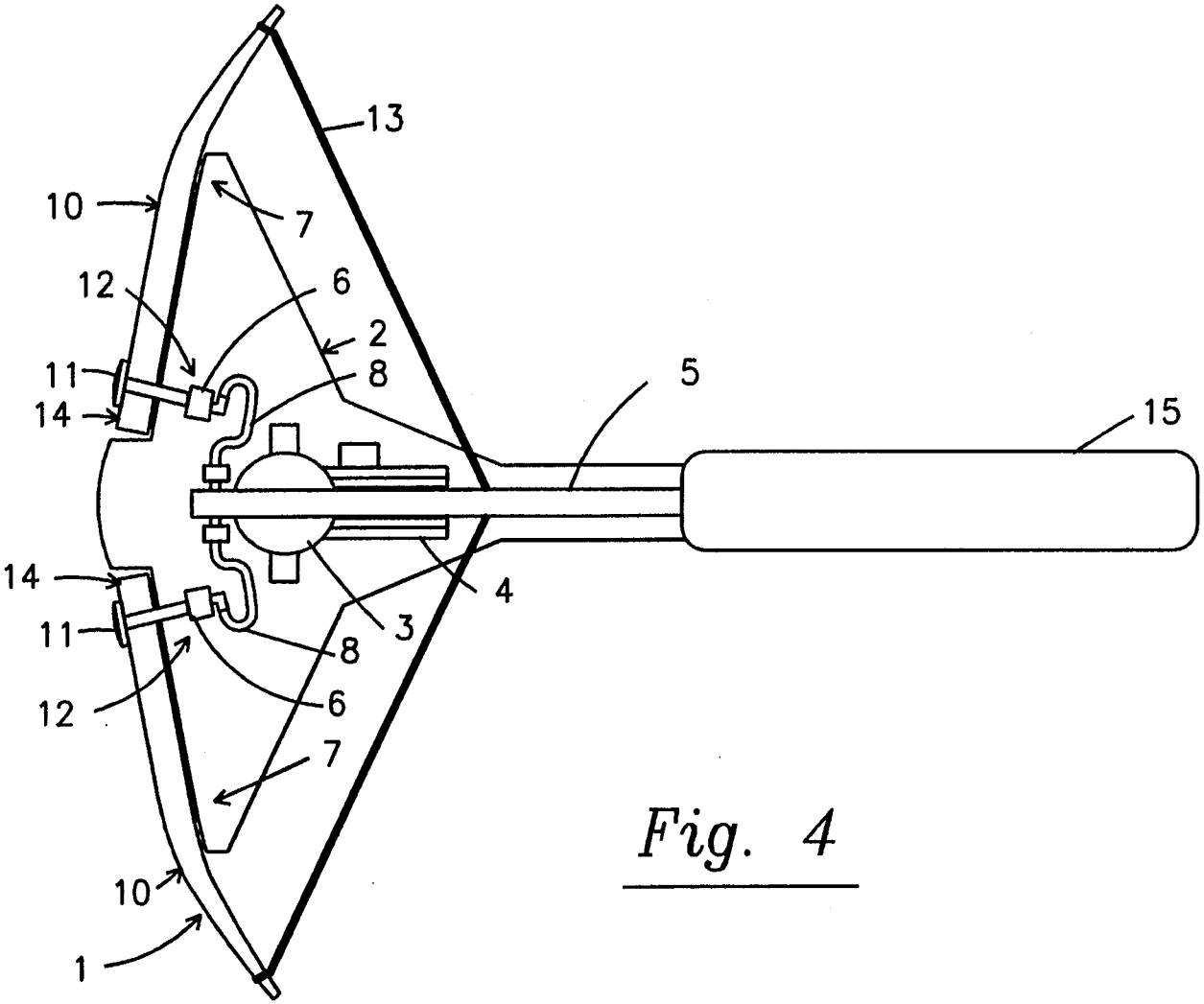
FIG. 4 is a bottom view of a crossbow according to the present invention, incorporating the pinion embodiment, activated.

FIGS. 3 and 4

A second embodiment shown in FIGS. 3 and 4, involves use of expanding fluid cylinders 6 to pull the inner ends 14 of the tensioning arms 1. In this embodiment, increased fluid pressure is conveyed from the pump 3 to the fluid cylinders 6 attached to a fluid cylinder area, or pinion area 12, of the frame 2. The inner ends 14 of the tensioning arms 1 are held to the frame 2 by a pinion 11 which connects to the frame 2 at the pinion area 12. The outer ends of the tensioning arms 1 are held by the string 13. When the string 13 is pulled, both ends of the tensioning arms 1 are pulled while the tensioning arms 1 are not allowed to move at their center due to pressure from the fulcrum areas 7 of the frame 2. The resulting bending of the tensioning arms 1, and the potential energy associated with it, is the source of energy which projects the missile forward.

By pulling the pinion 11 closer to the frame 2, the bending angle of the tensioning arms 1, and consequently the potential energy, is increased. Increased fluid pressure, which is transferred from the pump 3 to the fluid cylinder 6 by means of fluid lines 8 (which may be plastic) is used to expand the fluid cylinders 6. The expanding end of the cylinders 6 are connected to means for converting changes in fluid cylinder 6 extension into bending and tension of the tensioning arms 1, or pinions 11. Expansion of the cylinders 6 results in a pulling action upon the pinions 11. This pulling action increases the bending angle and the potential energy of the tensioning arms 1 and therefore leads to greater speed of the missile.

FIG. 5

Figure 5:
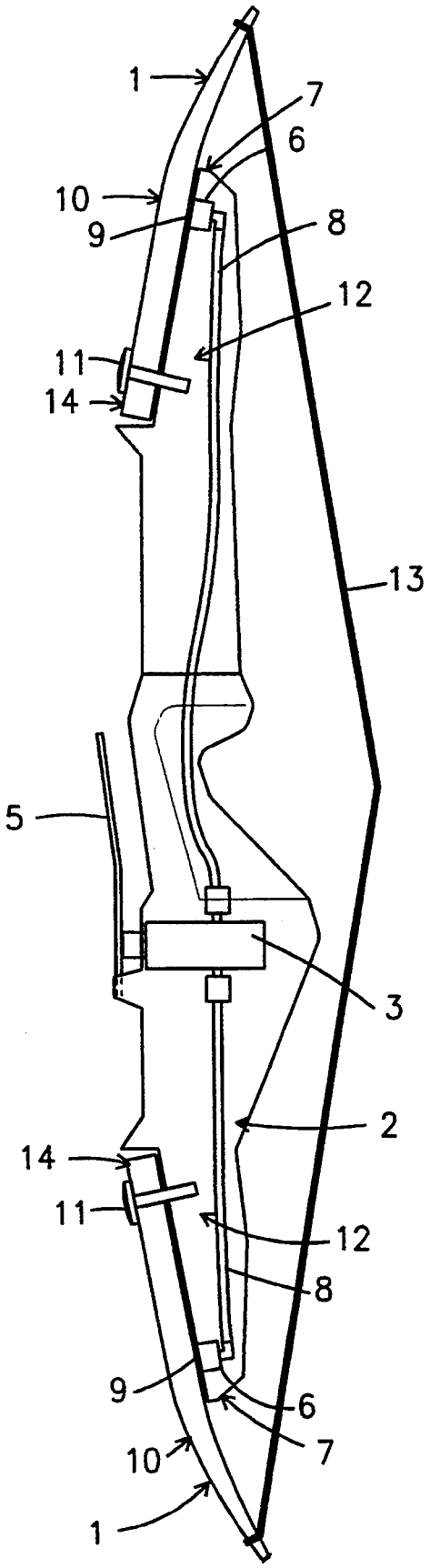
FIG. 5 is a side view of an archery bow according to the present invention.

FIG. 5 depicts a bow according to the present invention. The bow depicted in FIG. 5 involves expanding fluid cylinders 6 to press upon a central section 10 of tensioning arms 1 to produce the desired increase in tension. The alternative embodiment, which for the crossbow was illustrated in FIGS. 3 and 4, is not described as it can easily be inferred from the description of FIGS. 3 and 4 above. The bow in FIG. 5 is shown at rest, that is, without the string 13 being pulled nor the fluid cylinders 6 being extended.

Once the string 13 is pulled and held and the tensioning arms 1 are bent as a result of being held at their inner ends 14 by the pinion 11 to a pinion area 12 of the frame 2 and the middle portion 10 of the tensioning arms 1 pressing against a fulcrum area 7, the present invention embodiment is used to increase the tension in the arms.

Action of the pump 3, which may be a hydraulic or fluidic pump, increases the pressure of a fluid such as a hydraulic fluid. The pump may be operated by a pump arm on the front, or by electrical means, or by any other pump operating means. The increased pressure in the fluid is conveyed along fluid lines 8 to fluid cylinders 6 mounted in fluid cylinder areas, generally indicated as 7. Expansion of the fluid cylinders 6 as a result of increased fluid pressure presses upon the rams 9 which press upon the middle section 10 of the tensioning arms 1. The increased central pressure results in increased bending angle and therefore greater potential energy for delivery to the missile.

Alternative Embodiments

In this description, both the rams 9 and the pinions 11 are means for converting changes in fluid cylinder 6 extension into increased bending and tension of the tensioning arms 1. Other means might include welding or attaching the arms 1 directly to the cylinders 6; rivets, nails, and similar connectors; and lumps, projections, and other modifications to the tensioning arms 1.

It will thus be seen that the objects set forth above among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A bow having a central frame with a front end, two arms each having inner ends connected to said frame and outer ends connected to each other by a string and a first section defined by an area between their respective inner and outer ends, comprising:

means for pumping fluid mounted on said frame, whereby pressure of a fluid may be increased resulting in increased fluid pressure;

at least two fluid cylinder areas contained in said front end;

at least one fluid cylinder contained in each of said fluid cylinder areas;

at least one fluid line in fluid communication between each said fluid cylinder and said means for pumping, whereby increased fluid pressure is conveyed to said fluid cylinder and results in a change of extension of said fluid cylinder; and means for converting changes in extension of said fluid cylinders into increased bending and tension of said arms, said means for converting being connected to said fluid cylinders and extending from said front end, whereby an increase in fluid pressure caused by said means for pumping changes the extension of said fluid cylinders and increases tension of said arms.

2. The bow of claim 1 wherein said fluid is an hydraulic fluid, further comprising:

a pump arm extending from said means for pumping; and a fluid reservoir mounted to said frame proximal to and in fluid communication with said means for pumping.

3. The bow of claim 2 wherein said bow is a crossbow.

4. The crossbow of claim 3 wherein said means for converting comprises at least one ram pressing against each of said first sections, whereby increased fluid pressure causes pressure upon said first sections and bends said arms.

5. The crossbow of claim 3 wherein said means for converting comprises at least one pinion connected to each of said inner ends, whereby increased fluid pressure causes a pull upon said inner ends and bends said arms.

6. The bow of claim 2 wherein said bow is selected from the group consisting of archery bows and compound bows.

7. A method for using a bow comprising:

pulling on the center of a string connecting the outer ends of tensioning arms;

bending said tensioning arms;

holding the center of said string in a pulled position, which holds said tensioning arms in a bent position;

increasing the pressure of a fluid;

conveying said increased fluid pressure to fluid cylinder areas; and expanding fluid cylinders in fulcrum areas to apply force to said tensioning arms, whereby the bending angle and tension of said tensioning arms is increased.

8. In a bow having tensioning arms connected to a frame and a string connecting the outer ends of said arms, said frame having a front end, said tensioning arms having a inner and an outer end, said tensioning arms having a first section disposed between said inner end and said outer end, the improvement comprising:

at least one fluid cylinder area supported on said front end;

means for pumping fluid mounted on said frame, whereby fluid pressure is increased;

at least one fluid line connected with said pump, whereby increased fluid pressure is conveyed through said fluid line;

at least one fluid cylinder contained in said fluid cylinder area, said fluid cylinder having a first and second end, said fluid cylinder being connected to said fluid line at said first end, said fluid cylinder in fluid connection with said pumping means through said fluid line, said fluid cylinder being extendable; and means for converting changes in extension of said fluid cylinders into increased bending and tension of said tensioning arm, said converting means connected to said second end and to said tensioning arm.

9. The improvement as defined in claim 8 wherein:

said fluid is an hydraulic fluid;

said means for pumping fluid is a pump arm extending from said pump; and further comprising a fluid reservoir in fluid connection with said means for pumping fluid.

10. The improvement as defined in claim 9 wherein the bow is a crossbow.

* * * * *